US009404634B2

(12) United States Patent
Wilcox et al.

(10) Patent No.: US 9,404,634 B2
(45) Date of Patent: Aug. 2, 2016

(54) LED LIGHT FIXTURE WITH FACILITATED LENSING ALIGNMENT AND METHOD OF MANUFACTURE

(75) Inventors: Kurt S. Wilcox, Libertyville, IL (US); Christopher Strom, Racine, WI (US); Craig Raleigh, Racine, WI (US)

(73) Assignee: Cree, Inc., Durham, NC (US)

( * ) Notice: Subject to any disclaimer, the term of this patent is extended or adjusted under 35 U.S.C. 154(b) by 34 days.

(21) Appl. No.: 13/441,571

(22) Filed: Apr. 6, 2012

(65) Prior Publication Data

US 2012/0281404 A1 Nov. 8, 2012

Related U.S. Application Data

(63) Continuation-in-part of application No. 12/610,077, filed on Oct. 30, 2009, now Pat. No. 8,348,461.

(51) Int. Cl.

| | |
|---|---|
| ***F21S 4/00*** | (2016.01) |
| ***F21V 5/00*** | (2015.01) |
| ***F21S 2/00*** | (2016.01) |
| ***F21V 5/04*** | (2006.01) |
| ***F21V 5/08*** | (2006.01) |

(Continued)

(52) U.S. Cl.

CPC ..... *F21V 5/007* (2013.01); *F21S 2/005* (2013.01); *F21V 5/04* (2013.01); *F21V 5/08* (2013.01); *F21V 25/12* (2013.01); *F21V 29/763* (2015.01); *F21V 31/005* (2013.01); *F21V 7/0008* (2013.01); *F21W 2131/103* (2013.01); *F21Y 2101/02* (2013.01); *F21Y 2105/001* (2013.01); *Y10T 29/49895* (2015.01)

(58) Field of Classification Search

CPC .... B60Q 1/26; B60Q 1/2696; F21Y 2101/02; F21Y 2105/001; F21Y 2113/005; F21Y 2013/003; F21V 5/04; F21V 5/004; F21V 31/005; F21V 17/04; F21V 29/004; F21V 5/007; F21V 5/008; F21V 23/06; G02B 19/0009; G02B 19/0014; G02B 27/0955; F21S 48/215; Y10T 29/49895

USPC ..... 362/227, 240, 249.01, 249.02, 236, 362/237, 267, 294, 373, 612, 613, 800

See application file for complete search history.

(56) References Cited

U.S. PATENT DOCUMENTS 4,254,453 A 3/1981 Mouyard et al.
5,272,602 A * 12/1993 Sasajima et al. ..... 362/549

(Continued)

FOREIGN PATENT DOCUMENTS

CN 2220007 Y 2/1996
CN 101315167 A 12/2008

(Continued)

*Primary Examiner* — Hargobind S Sawhney

(74) *Attorney, Agent, or Firm* — Jansson Munger McKinley & Kirby Ltd.

(57) ABSTRACT

LED lighting apparatus including (1) a plurality of primary lenses each over a corresponding one of LED arrays spaced on a circuit board, and (2) a one-piece lensing member over the circuit board and having a plurality of secondary lenses each spaced over one of the primary lenses on the circuit board, the circuit board and lensing member having first and second mating features positioned and configured for inter-engagement for high-precision lens alignment. The circuit board and one-piece lensing member are each joined to a mounting surface of a heat-conductive member, and such assembly, while facilitating high-efficiency assembly, does not interfere with high-precision lens alignment.

18 Claims, 7 Drawing Sheets

(51) Int. Cl.

| | |
|---|---|
| ***F21V 25/12*** | (2006.01) |
| ***F21V 31/00*** | (2006.01) |
| ***F21V 29/76*** | (2015.01) |
| *F21V 7/00* | (2006.01) |
| *F21W 131/103* | (2006.01) |
| *F21Y 101/02* | (2006.01) |
| *F21Y 105/00* | (2016.01) |

(56) References Cited

U.S. PATENT DOCUMENTS

| | | | | |
|---|---|---|---|---|
| 5,617,131 | A | 4/1997 | Murano et al. | |
| 5,636,057 | A * | 6/1997 | Dick et al. | 359/625 |
| 5,722,760 | A | 3/1998 | Chien | |
| 6,502,953 | B2 | 1/2003 | Hajianpour | |
| 6,502,956 | B1 | 1/2003 | Wu | |
| 7,093,958 | B2 | 8/2006 | Coushaine | |
| 7,255,460 | B2 * | 8/2007 | Lee | 362/294 |
| 7,682,853 | B2 | 3/2010 | Ashida | |
| 7,736,019 | B2 | 6/2010 | Shimada et al. | |
| 7,766,509 | B1 | 8/2010 | Laporte | |
| 7,991,147 | B2 | 8/2011 | Emmert | |
| 8,002,435 | B2 | 8/2011 | Laporte | |
| 8,100,540 | B2 * | 1/2012 | Huebner | 353/94 |
| 2002/0062170 | A1 | 5/2002 | Skunes et al. | |
| 2003/0031028 | A1 * | 2/2003 | Murray et al. | 362/545 |
| 2004/0135876 | A1 | 7/2004 | Ueda et al. | |
| 2006/0022214 | A1 | 2/2006 | Morgan et al. | |
| 2007/0201225 | A1 * | 8/2007 | Holder et al. | 362/227 |
| 2008/0239722 | A1 * | 10/2008 | Wilcox | 362/268 |
| 2008/0266852 | A1 | 10/2008 | Valerio et al. | |
| 2008/0273327 | A1 | 11/2008 | Wilcox et al. | |
| 2008/0298056 | A1 | 12/2008 | Petersen | |
| 2009/0262532 | A1 * | 10/2009 | Wilcox et al. | 362/248 |
| 2009/0298376 | A1 | 12/2009 | Guillien et al. | |
| 2009/0323332 | A1 * | 12/2009 | Lo et al. | 362/235 |
| 2011/0043120 | A1 | 2/2011 | Panagotacos et al. | |
| 2011/0103051 | A1 | 5/2011 | Wilcox et al. | |
| 2011/0115360 | A1 | 5/2011 | Holder et al. | |

FOREIGN PATENT DOCUMENTS

| | | | |
|---|---|---|---|
| DE | 202009008928 | U1 | 8/2009 |
| EP | 1413823 | A2 | 4/2004 |
| JP | 2007141585 | A | 6/2007 |
| JP | 2007258114 | A | 10/2007 |
| JP | 2008103300 | A | 5/2008 |
| JP | 3147703 | U | 12/2008 |
| JP | 2009230984 | A | 10/2009 |
| WO | WO2010011379 | A1 | 1/2010 |

* cited by examiner

LED LIGHT FIXTURE WITH FACILITATED LENSING ALIGNMENT AND METHOD OF MANUFACTURE

RELATED APPLICATIONS

This application is a continuation-in-part of currently pending U.S. application Ser. No. 12/610,077, filed on Oct. 30, 2009.

FIELD OF THE INVENTION

This invention relates generally to the field of LED light fixtures and, more particularly, to the field of LED light fixtures for various high-luminance area lighting applications such as roadway lighting, factory lighting, parking lot lighting, commercial building lighting, and the like, and to the manufacture thereof.

BACKGROUND OF THE INVENTION

In recent years, the use of light-emitting diodes (LEDs) in development of light fixtures for various common lighting purposes has increased, and this trend has accelerated as advances have been made in the field. Indeed, lighting applications which previously had typically been served by fixtures using what are known as high-intensity discharge (HID) lamps are now being served by LED light fixtures. Such lighting applications include, among a good many others, roadway lighting, factory lighting, parking lot lighting, and commercial building lighting.

In many of such products, achieving high levels of illumination over large areas with specific light-distribution requirements is particularly important. One example is fixtures for roadway lighting, an application in which the fixtures are generally placed along roadway edges while light distribution is desired along a significant portion of roadway length and, of course, on the roadway itself—generally to the exclusion of significant light off the roadway. And in such situations it is desirable to minimize the use of large complex reflectors and/or varying orientations of multiple light sources to achieve desired illumination patterns.

Achieving appropriate light distribution while avoiding or minimizing the use of complex reflectors and/or varying orientations of multiple light sources requires the use of lens systems for that purpose. And, where lens alignment plays a role in lens systems, maximizing their effectiveness requires high precision in lens alignment.

At the same time, it must be recognized that what is involved in manufacture of LED light fixtures for roadway illumination and the like is mass, preferably highly efficient, manufacture of light fixtures, rather than manufacture of extremely high-cost precision instruments such as for laboratory usage or the like. More specifically, it is of great importance that the economics of low-cost, high-efficiency manufacture be satisfied, but while still achieving the high-precision lens alignment necessary to maximize performance of high-luminance LED light fixtures for roadway illumination and the like.

SUMMARY OF THE INVENTION

The present invention is an improved LED light fixture with high-precision lens alignment, and a high-efficiency manufacturing method for such LED light fixture.

The method of this invention is a method of assembling an LED light fixture of the sort including (a) a heat-conductive structure having a mounting surface, (b) a circuit board having a plurality of LED arrays spaced thereon with a plurality of primary lenses each over a corresponding one of the LED arrays and (c) a one-piece lensing member having a plurality of secondary lenses each positioned to align with a corresponding one of the primary lenses. The inventive method includes: providing a set of mounting holes through the circuit board and a set of alignment holes in the circuit board; providing a set of mounting holes through the one-piece lensing member and a set of alignment protrusions extending from a circuit-board-adjacent surface of the lensing member; providing first and second sets of fastener-receiving cavities in the heat-conductive structure and open at the mounting surface thereof; mounting the circuit board to the mounting surface by inserting a first set of fasteners through the circuit-board mounting holes into the first set of fastener-receiving cavities; aligning the lensing member with respect to the circuit board by mating engagement of the alignment protrusions with the alignment holes; and installing the lensing member over the circuit board by inserting a second set of fasteners through the lensing-member mounting holes into the second set of fastener-receiving cavities.

The lighting apparatus of this invention includes: (1) a plurality of primary lenses each over a corresponding LED array, the LED arrays spaced on a circuit board, the circuit board having a first mating feature; and (2) a one-piece lensing member over the circuit board, the circuit board including a plurality of secondary lenses each spaced over a corresponding one of the primary lenses, the one-piece lensing member having a second mating feature positioned and configured for mating engagement with the first mating feature, the first and second mating features engaged to accurately align the secondary lenses over their corresponding primary lenses.

In some embodiments, the second mating feature is a protrusion extending from a circuit-board-adjacent surface of the one-piece lensing member, and the first mating feature is a complementary hole formed in an LED-supporting surface of the circuit board. In such embodiments, the lensing member may have first and second protrusions extending from its circuit-board-adjacent surface, and the circuit board defines (a) a first hole complementary in shape to the first protrusion to fix the position of the lensing member along the circuit board and (b) a second hole receiving the second protrusion to prevent rotation of the lensing member about the first protrusion. The second hole may be elongate along a line extending between the first and second holes to facilitate engagement of the mating features.

Certain embodiments of the present invention also include the heat-conductive structure including a mounting surface to which the circuit board and the lensing member are secured. The heat-conductive structure has first and second sets of fastener-receiving cavities open at the mounting surface. The circuit board is mounted to the heat-conductive structure with fasteners extending through mounting holes in the circuit board and into the first set of fastener-receiving cavities. The one-piece lensing member is secured to the heat-conductive structure by fasteners inserted through holes in the one-piece lensing member and into the second set of fastener-receiving cavities.

The one-piece lensing member may have a peripheral portion extending beyond the edge of the circuit board. Such peripheral portion preferably encircles the circuit board and engages a gasket providing a weathertight seal around the circuit board. The one-piece lensing member may be of a polymeric material, and compression-limiting inserts are in each of the holes of the one-piece lensing member.

Precise alignment of lenses give the full light-distribution benefits that are intended is achieved by this invention, while still allowing highly-efficient assembly.

In descriptions of this invention, including in the claims below, the terms "comprising," "including" and "having" (each in their various forms) and the term "with" are each to be understood as being open-ended, rather than limiting, terms.

DETAILED DESCRIPTION OF CERTAIN EMBODIMENTS

FIGS. 1-9 illustrate LED light fixture 10 according to the present invention and a high-efficiency manufacturing method for such LED light fixture 10 which gives high-precision lens alignment.

Figure 1:
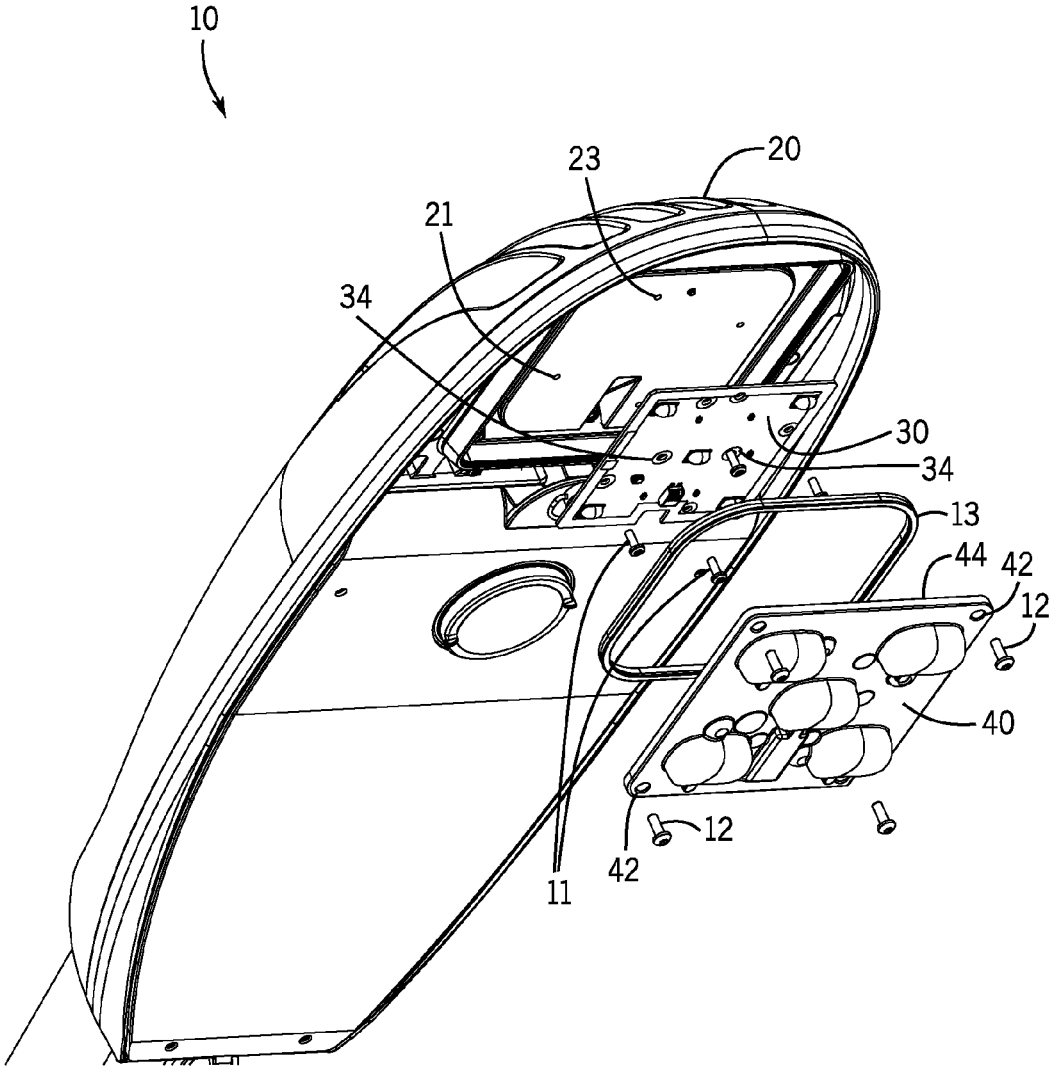
FIG. 1 is an exploded bottom perspective view of an LED light fixture according to the present invention.
Figure 2:
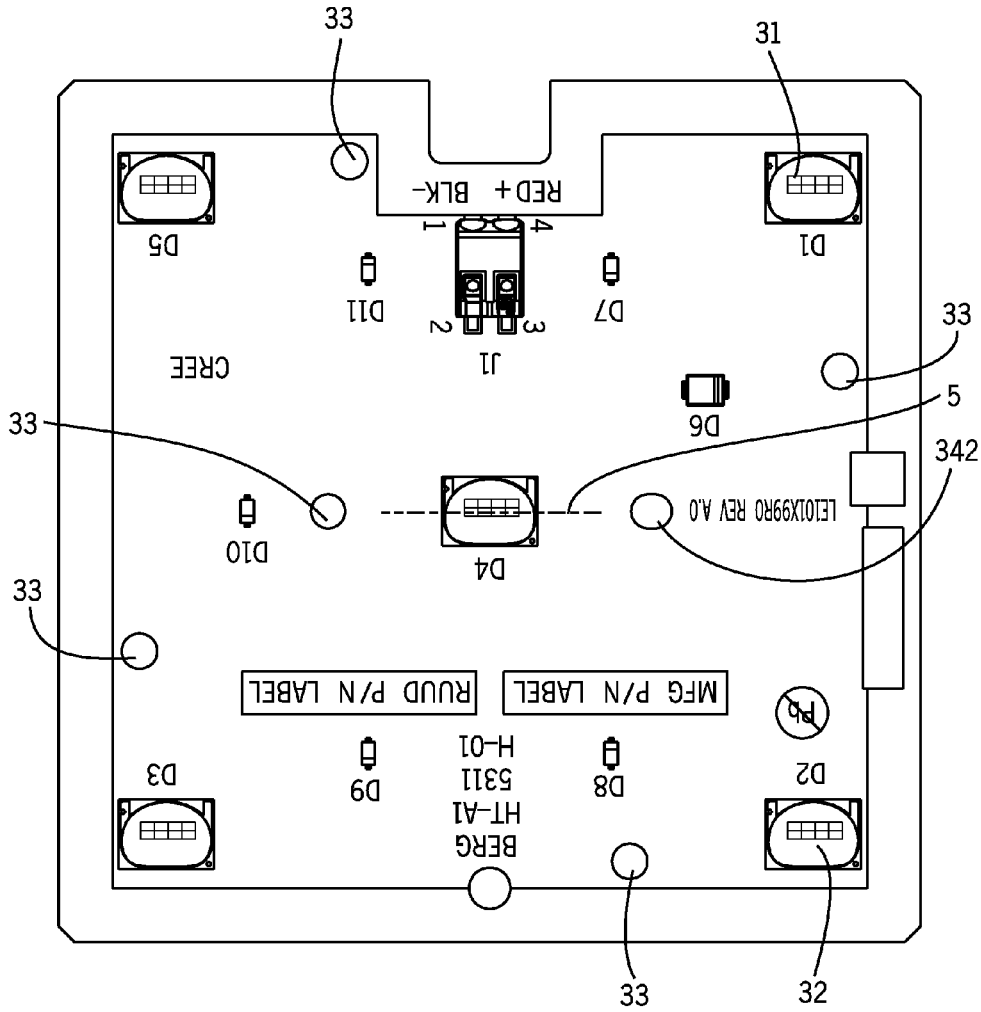
FIG. 2 is a plan view of a circuit board.
Figure 3:
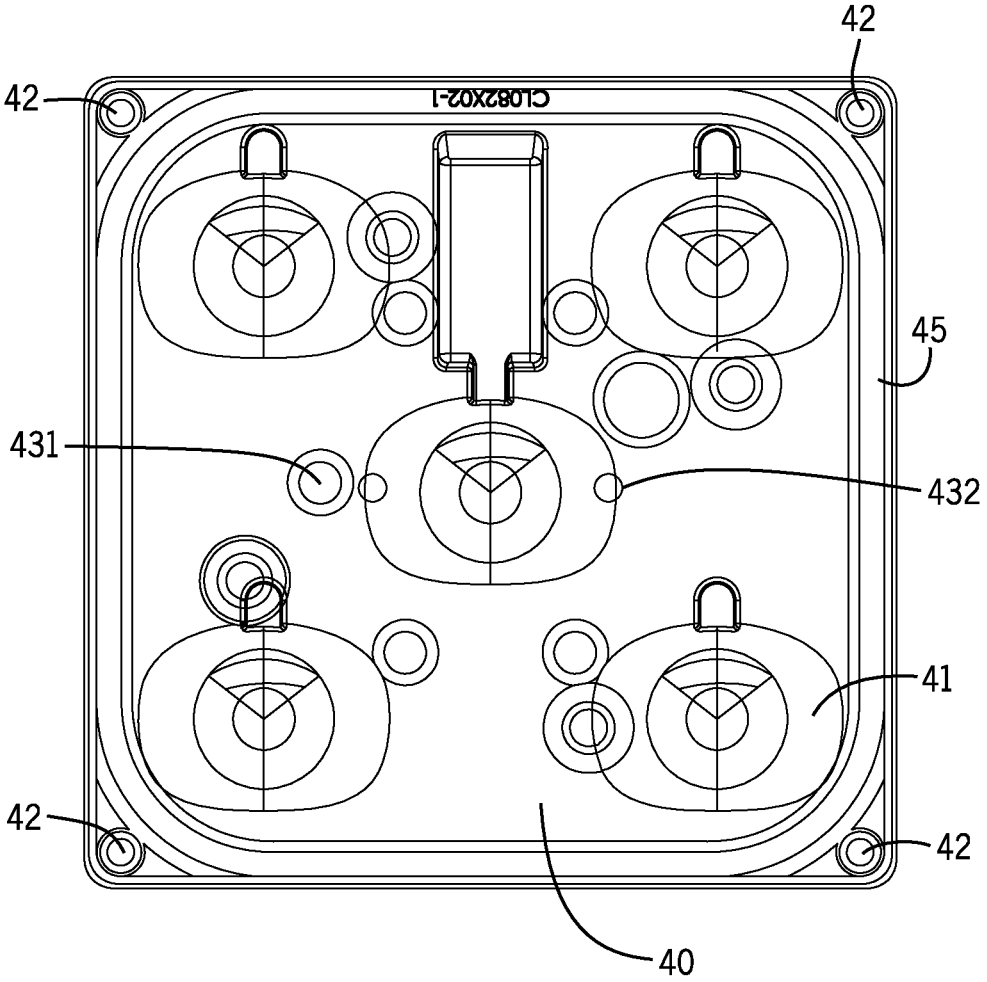
FIG. 3 is a plan view of a one-piece lensing member.
Figure 4:
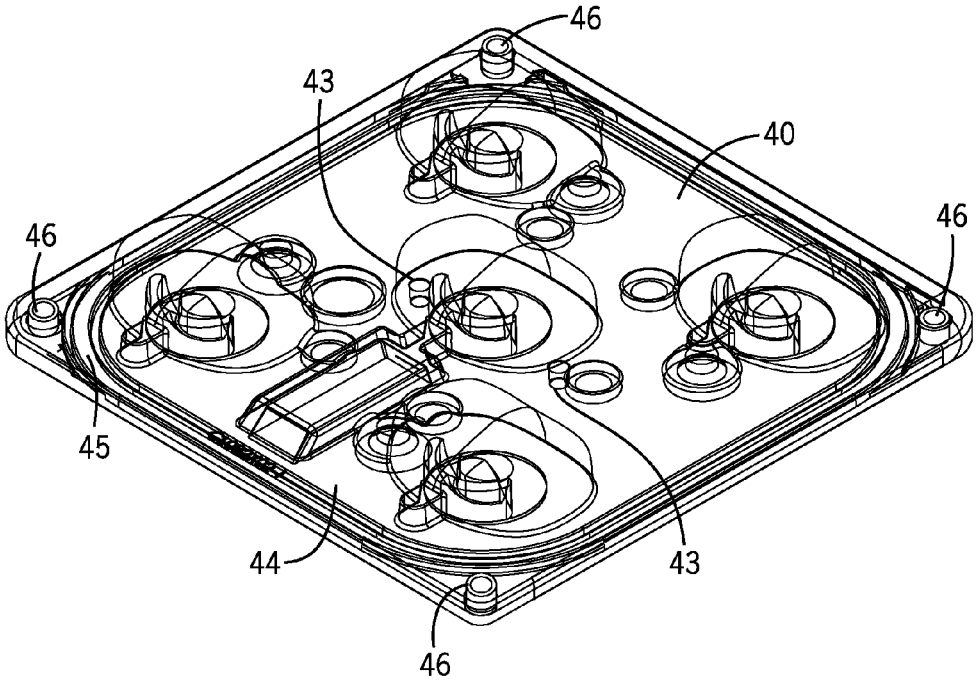
FIG. 4 is a perspective view of the lensing member of FIG. 3.
Figure 5:
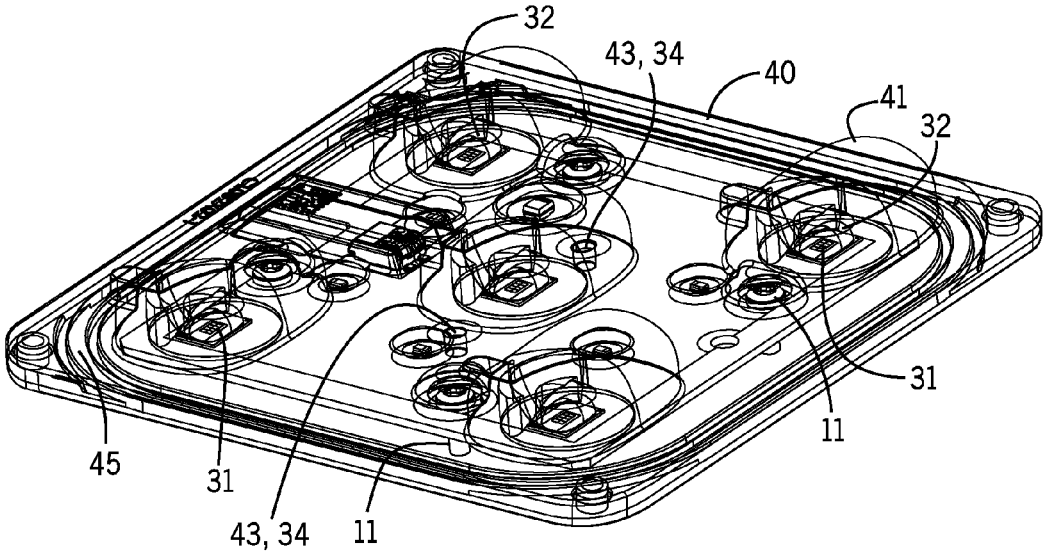
FIG. 5 is a perspective view of the lensing member of FIG. 3 aligned over the circuit board.
Figure 6:
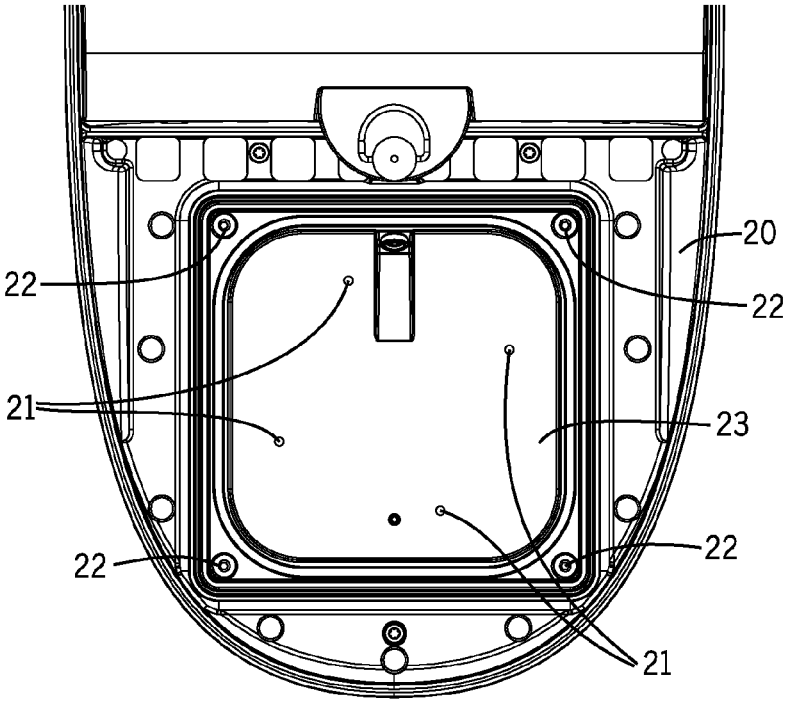
FIG. 6 is a plan view of a mounting surface of a heat-conductive structure.

FIG. 1-5 best illustrates that LED light fixture 10 includes a heat-conductive structure 20, a circuit board 30 and a one-piece lensing member 40. Heat-conductive structure 20 has a mounting surface 23 best seen in FIGS. 1 and 6. FIGS. 1, 2 and 5 best illustrate circuit board 30 which has a plurality of LED arrays 31 spaced thereon with a plurality of primary lenses 32 each over a corresponding one of LED arrays 31. FIGS. 3-5 best show one-piece lensing member 40 having a plurality of secondary lenses 41 each positioned to align with a corresponding one of primary lenses 32.

In the inventive method, a set of mounting holes 33 is provided through circuit board 30 and a set of alignment holes 34 is provided in the circuit board 30, as best seen in FIG. 2. A set of mounting holes 42 (best seen in FIG. 3) is also provided through one-piece lensing member 40. A set of alignment protrusions 43 (best seen in FIGS. 3 and 4) is also provided, protrusions 43 extend from a circuit-board-adjacent surface 44 of lensing member 40. In heat-conductive structure 20, first and second sets of fastener-receiving cavities 21 and 22.

Figure 7:
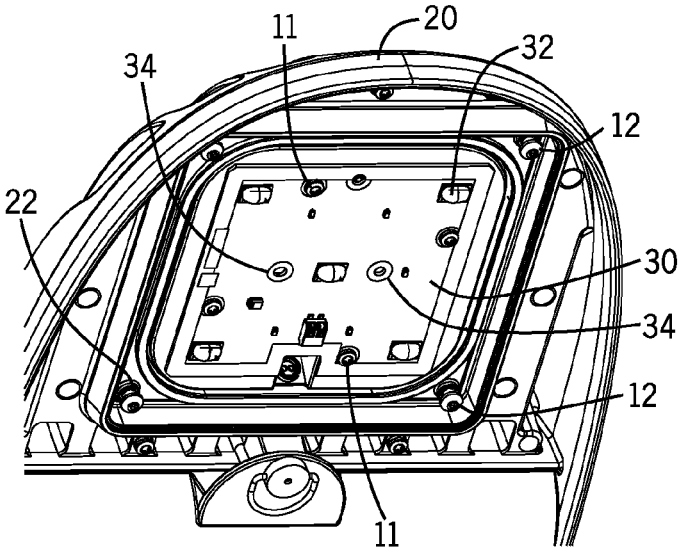
FIG. 7 is a perspective view showing the circuit board mounted to the heat-conductive structure.
Figure 8:
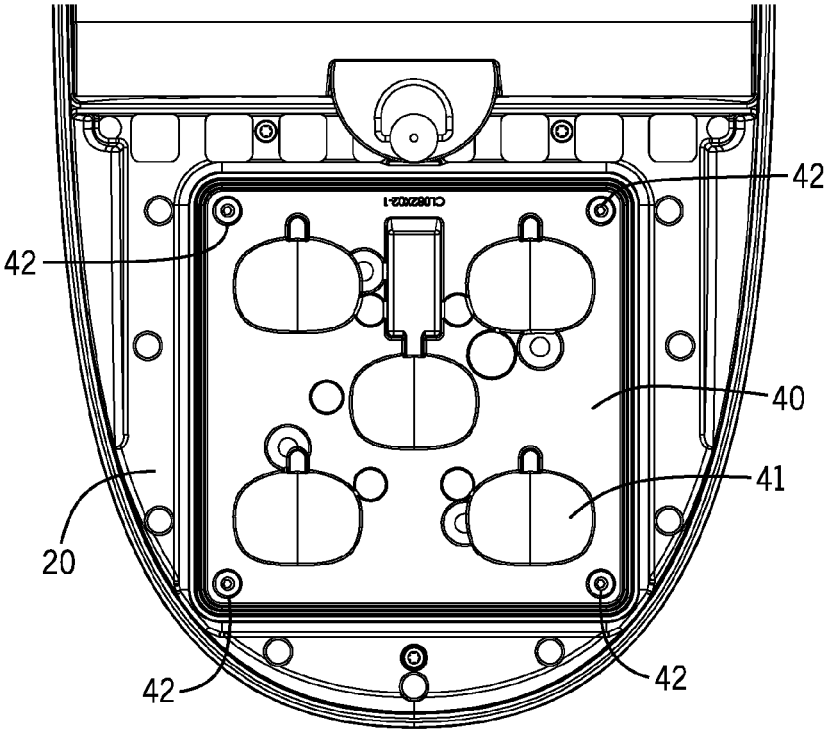
FIG. 8 is a perspective view showing the lensing member aligned over the circuit board mounted to the heat-conductive structure.
Figure 9:
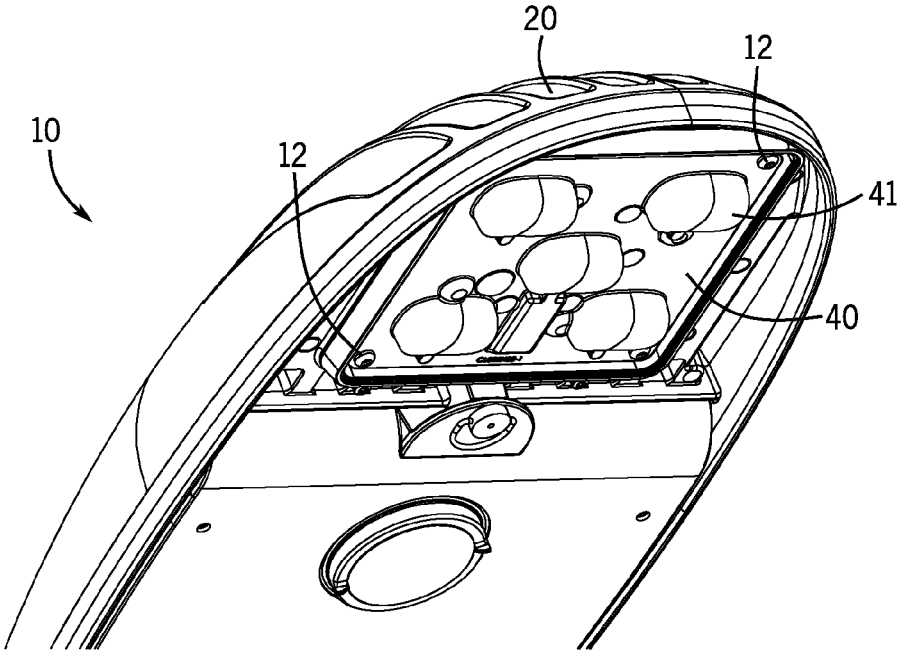
FIG. 9 is a perspective view showing the lensing member installed to the heat-conductive structure.
Figure 10:
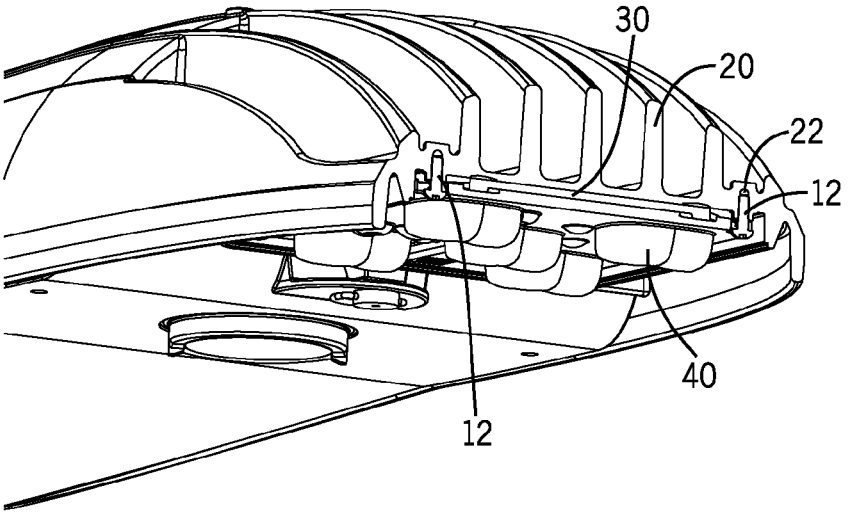
FIG. 10 is a perspective sectional view across the heat-conductive structure and showing securement of the one-piece lensing member to the heat-conductive structure.
Figure 11:
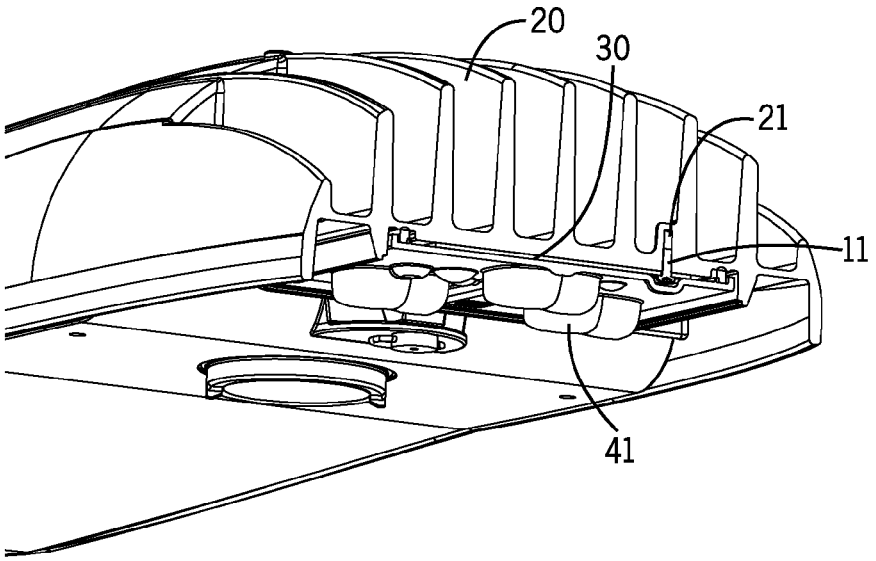
FIG. 11 is a perspective sectional view across the heat-conductive structure and showing mounting of the circuit board to the heat-conductive structure.

As seen in FIG. 1, cavities 21 and 22 are open at mounting surface 23 of heat-conductive structure 20. FIGS. 1, 7 and 11 show that circuit board 30 is mounted to mounting surface 23 by inserting a first set of fasteners 11 through circuit-board mounting holes 33 into first set of fastener-receiving cavities 21. FIG. 5 illustrates alignment of lensing member 40 with respect to circuit board 30 by mating engagement of alignment protrusions 43 with alignment holes 34 such that secondary lenses 41 are accurately aligned over their corresponding primary lenses 32. FIGS. 1 and 10 show that lensing member 40 is installed over circuit board 30 by inserting a second set of fasteners 12 through lensing-member mounting holes 42 into second set of fastener-receiving cavities 22.

It is best seen in FIGS. 3-5 that lensing member 40 has first and second protrusions 431 and 432 extending from its circuit-board-adjacent surface 44. FIG. 2 shows that circuit board 30 defines first and second alignment holes 341 and 342. First hole 341 is complementary in shape to first protrusion 431 to fix the position of lensing member 40 along circuit board 30. And, as seen in FIG. 5, second hole 342 receives second protrusion 432 to prevent rotation of lensing member 40 about first protrusion 431. FIG. 2 further shows second hole 342 elongate along a line 35 extending between first and second holes 341 and 342. This facilitates engagement of mating features in the form of alignment holes 34 and protrusions 43.

FIGS. 1, 5, 10 and 11 show that one-piece lensing member 40 has a peripheral portion 45 extending beyond edge 36 of circuit board 30. Peripheral portion 45 encircles circuit board 30 and engages a gasket 13 which provides a weathertight seal around circuit board 30. Since one-piece lensing member 40 may be of a polymeric material, compression-limiting inserts 46 in such embodiments are used in each of mounting holes 42 of one-piece lensing member 40.

While the principles of the invention have been shown and described in connection with specific embodiments, it is to be understood that such embodiments are by way of example and are not limiting.

The invention claimed is:

1. A method of assembling an LED light fixture, the fixture including (a) a heat-conductive structure having a mounting surface, (b) a circuit board having a plurality of LED arrays spaced thereon with a plurality of primary lenses each over a corresponding one of the LED arrays and (c) a one-piece lensing member having a plurality of secondary lenses each positioned to align with a corresponding one of the primary lenses, the method comprising:

providing a set of mounting holes through the circuit board and a set of alignment holes in the circuit board;

providing a set of mounting holes through the one-piece lensing member and a set of alignment protrusions extending from a circuit-board-adjacent surface of the lensing member;

providing first and second sets of fastener-receiving cavities in the heat-conductive structure and open at the mounting surface thereof;

mounting the circuit board to the mounting surface by inserting a first set of fasteners through the circuit-board mounting holes into the first set of fastener-receiving cavities;

aligning the lensing member with respect to the circuit board by mating engagement of the alignment protrusions with the alignment holes; and installing the lensing member over the circuit board by inserting a second set of fasteners through the lensing-member mounting holes into the second set of fastener-receiving cavities.

2. The method of claim 1 wherein the set of alignment protrusions includes first and second protrusions and the set of alignment holes includes a first hole complementary in shape to the first protrusion to fix the position of the lensing member along the circuit board, and a second hole to receive the second protrusion and prevent rotation of the lensing member about the first protrusion.

3. The method of claim 2 wherein the second hole is elongate along a line extending between the first and second holes thereby to facilitate the mating engagement.

4. The method of claim 1 wherein the one-piece lensing member has a peripheral portion extending beyond the edge of the circuit board.

5. The method of claim 4 wherein the peripheral portion encircles the circuit board and engages a gasket providing a weathertight seal around the circuit board.

6. The method of claim 5 wherein:

the one-piece lensing member is of a polymeric material; and compression-limiting inserts are in each of the holes of the one-piece lensing member.

7. Lighting apparatus comprising:

a heat-conductive structure having a mounting surface and first and second sets of fastener-receiving cavities;

a circuit board having a plurality of LED arrays spaced thereon with primary lenses each over a corresponding LED array, the circuit board having a first alignment feature and a set of mounting holes, the circuit board being mounted to the heat-conductive structure with fasteners extending through the mounting holes into the first set of fastener-receiving cavities; and a one-piece lensing member over the circuit board and having a second alignment feature, the one-piece lensing member being secured to the heat-conductive structure with fasteners inserted into the second set of fastener-receiving cavities through the lensing-member mounting holes defined in a peripheral portion extending beyond the edge of the circuit board, the one-piece lensing member including a plurality of secondary lenses each over a corresponding one of the primary lenses, the second alignment feature being in mating engagement with the first alignment feature, thereby aligning the secondary lenses over their corresponding primary lenses.

8. The lighting apparatus of claim 7 wherein:

the second alignment feature is a protrusion extending from a circuit-board-adjacent surface of the one-piece lensing member; and the first alignment feature is a complementary hole formed in an LED-supporting surface of the circuit board.

9. Lighting apparatus comprising:

a plurality of LED emitters spaced on a circuit board;

a lensing member over the circuit board and including a plurality of secondary lenses each spaced over a corresponding one of the LED emitters, the lensing member including first and second lens-alignment features which are one of protrusions and hollows of a circuit-board-adjacent surface; and the circuit board defining a first board-alignment feature which is one of a hole and a protrusion defined by an LED-supporting surface of the circuit board and being complementary in shape to with the first lens-alignment feature for mating engagement therebetween to fix the position of the lensing member along the circuit board, and a second board-alignment feature which is one of a hole and a protrusion for engagement with the second lens-alignment feature to prevent rotation of the lensing member about the first lens-alignment feature.

10. The lighting apparatus of claim 9 wherein:

the first and second lens-alignment features are protrusions; and the first board-alignment features is a hole complementary in shape to the first lens-alignment protrusion; and the second board-alignment feature is a hole elongate along a line extending between the first and second holes thereby to facilitate mating engagement of the first lens-alignment feature with the first board-alignment features.

11. The lighting apparatus of claim 9 further including a heat-conductive structure having a mounting surface and having first and second sets of fastener-receiving cavities, the circuit board being mounted to the heat-conductive structure with fasteners extending through mounting holes in the circuit board into the first set of fastener-receiving cavities.

12. The lighting apparatus of claim 11 wherein the one-piece lensing member is secured to the heat-conductive structure with fasteners inserted through holes in the one-piece lensing member into the second set of fastener-receiving cavities.

13. The lighting apparatus of claim 12 wherein:

the one-piece lensing member is of a polymeric material; and compression-limiting inserts are in each of the holes of the one-piece lensing member.

14. Lighting apparatus comprising:

a plurality of LED light sources spaced on a circuit board;

a one-piece lensing member over the circuit board and including a plurality of lenses each spaced over a corresponding one of the LED light sources, the lensing member having first and second protrusions extending from a circuit-board-adjacent surface; and the circuit board defining (i) a first hole complementary in shape to the first protrusion to fix the position of the lensing member along the circuit board and (ii) a second hole receiving the second protrusion to prevent rotation of the lensing member about the first protrusion.

15. The lighting apparatus of claim 14 wherein the second hole is elongate along a line extending between the first and second holes thereby to facilitate engagement of the mating features.

16. The lighting apparatus of claim 14 wherein each LED light source includes an array of LEDs.

17. The lighting apparatus of claim 16 wherein each light source includes a primary lens over the LED array.

18. The lighting apparatus of claim 17 wherein each of the primary lenses is overmolded on one of the LED arrays.

* * * * *